US006761633B2

(12) United States Patent
Riendeau et al.

(10) Patent No.: US 6,761,633 B2
(45) Date of Patent: Jul. 13, 2004

(54) GAME OF CHANCE WITH MULTIPLE PATHS ON A VIRTUAL SCRATCH TICKET

(75) Inventors: Timothy Riendeau, Ledyard, CT (US); John DeTora, Ashaway, RI (US); Matthew McAllister, East Greenwich, RI (US); Sharon Gannon, North Kingstown, RI (US); Jasmin Blackmar, Cranston, RI (US); Clifton Dutton, Providence, RI (US)

(73) Assignee: GTECH Rhode Island Corporation, West Greenwich, RI (US)

( * ) Notice: Subject to any disclaimer, the term of this patent is extended or adjusted under 35 U.S.C. 154(b) by 7 days.

(21) Appl. No.: 09/871,462

(22) Filed: May 31, 2001

(65) Prior Publication Data

US 2002/0082071 A1 Jun. 27, 2002

Related U.S. Application Data

(60) Provisional application No. 60/209,111, filed on Jun. 2, 2000.

(51) Int. Cl.[7] ..... A63F 13/00
(52) U.S. Cl. ..... 463/16; 463/25
(58) Field of Search ..... 463/16–20, 42

(56) References Cited

U.S. PATENT DOCUMENTS 4,652,998 A * 3/1987 Koza et al. ..... 463/26
5,362,049 A * 11/1994 Hofer ..... 463/7
5,393,071 A 2/1995 Best
5,569,082 A 10/1996 Kaye
5,769,714 A 6/1998 Wiener et al.
5,980,384 A * 11/1999 Barrie ..... 463/16
5,996,997 A 12/1999 Kamille
6,012,982 A 1/2000 Piechowiak et al.
6,050,895 A 4/2000 Luciano, Jr. et al.
6,176,487 B1 * 1/2001 Eklund et al. ..... 273/249
6,179,713 B1 * 1/2001 James et al. ..... 463/42
6,368,218 B2 * 4/2002 Angell, Jr. ..... 463/40

FOREIGN PATENT DOCUMENTS

GB 2144644 * 3/1985
WO WO 94/12256 6/1994
WO WO 97/27921 8/1997
WO WO 98/26361 6/1998
WO WO 98/36809 8/1998
WO WO 00/25281 5/2000

* cited by examiner

*Primary Examiner*—John M. Hotaling, II
(74) *Attorney, Agent, or Firm*—Kenyon & Kenyon

(57) ABSTRACT

An online game of chance and methods of conducting and playing the game on a virtual instant ticket are disclosed. The game is based on a map having multiple branches and nodes, where a desired path is selected by clicking on the branch or node as play progresses between a starting point and multiple finishing points. Each available branch or node that is selected results in a prize value being increased, decreased, or a token being awarded for later use in the game. In a single player mode, a final prize is awarded to the player. In multiple player modes, the final prize is divided among the players according to predetermined criteria.

25 Claims, 9 Drawing Sheets

GAME OF CHANCE WITH MULTIPLE PATHS ON A VIRTUAL SCRATCH TICKET

REFERENCE TO RELATED APPLICATION(S)

The present invention claims a right of priority to provisional application Ser. No. 60/209,111 entitled "Game of Chance," which was filed in the United States Patent and Trademark Office on Jun. 2, 2000.

FIELD OF THE INVENTION

The present invention relates to an online game of chance and a method of playing the game. More precisely, the invention relates to an instant-type ticket game that is played online by one or more players, the game having multiple paths which provide different outcomes depending on the path chosen.

DESCRIPTION OF THE RELATED ART

As in many areas of commerce, the emergence and proliferation of the Internet has revolutionized gaming, making it possible for those who cannot physically access traditional "brick and mortar" type gaming facilities, e.g., Off-Track Betting or parimutuel offices, casinos, river boats, etc. to experience the thrill and excitement that can accompany games of chance "virtually", which is to say in cyber-space.

For example, patents have been issued for online gaming architecture, e.g., U.S. Pat. No. 6,152,824 to Rothschild, et al. Architecture patents, such as the one to Rothschild, et al., typically disclose a networked computer system for online gaming that couples a plurality of client, or player, computers to a plurality of server computers. Further, patents have been issued for interactive game systems, e.g., U.S. Pat. No. 6,227,974 to Eilat et al. Interactive game systems, such as the one to Eilat et al., typically enable a first player to compete against a second player via a communication link. Indeed, there are even patents covering online game playing with advertising, e.g., U.S. Pat. No. 6,196,920 to Spaur et al., and patents for online gaming using integrated circuit "smart" cards for payment, e.g., U.S. Pat. No. 4,764,666 to Bergeron.

In general, online games can be played individually or can be played by a plurality of players. Individual games pit the player against "the machine" or "the house," but the only real excitement created during play is that which accompanies winning the game. Moreover, only individual games do not necessarily require a network to play as players can play a game with their own personal computer. Multiple player games, on the other hand, can include (i) multiple players (but usually just two) playing the same game on the same computer; (ii) multiple players (but usually just two) playing the same game on remote computers using, e.g., modems and a telephone line; and (iii) multiple players (generally more than two) playing the same game on remote computers using, e.g., a local area network (LAN), a wide area network (WAN), and/or the Internet. In each of these embodiments of multiple-player games, players vie against each other and "the machine," which adds an additional layer of excitement to the gaming experience.

One example of a networked, multiple-player game is disclosed in U.S. Pat. No. 6,179,713 to James et al. The James et al. patent discloses a turn-based, multiple-player, Internet game for a large number of players in which players can input moves sequentially, i.e., on their turn. A salient feature of the James et al. patent is that players are allowed to change moves during a turn. A problem with the James et al. patent is that the game is time-consuming; hence, some players may lose interest and abort playing the game, which may leave a "hole" in the game. Furthermore, the rules of the game are quite complex.

SUMMARY OF THE INVENTION

An online game of chance and methods of conducting and playing the game are disclosed, wherein the game is an online instant-type ticket game played by one or more players. The game is arranged in the form of a map having a plurality of branches and nodes corresponding to paths which can be selected between a starting point and a plurality of finishing points Game play occurs as each player takes a turn in sequence clicking on a branch or node corresponding to a desired path. Each selection from one or more available branches or nodes results in a prize increment, a prize decrement, or an award of a bypass token. Bypass tokens can be accumulated and later used during the game to avoid prize decrements. The object of the game is to maximize the final score by maximizing the value of prize increments and minimizing the value of prize decrements. When one of the finishing points is reached, a final prize is awarded to the one or more players.

Preferably the game of chance can be played in one of three modes: single player, cooperative multiple player, and competitive multiple player. In single player mode, the player selects available branches or nodes between the starting and finishing points. Once a finishing point is reached, the player is awarded a cash value or credit equivalent of the player's final score.

In the multiple player modes, group play is facilitated with additional features including a game room area appearing on a game screen viewable by each player. The game room area preferably includes an avatar and/or score associated with the other players in the game. As used herein, the term "avatar" refers to a graphical depiction of a character or object which serves as a token or game piece for a player. A player's avatar (e.g. a monkey eating a banana) can be displayed on the screen along with a player's screen name and score. A chat room area on the game screen allows the players to communicate during the course of game play. In the multiple player (group play) modes, each player in the group takes a turn in sequence. In a cooperative multiple player mode, the players share the same score, and the final prize is divided equally. In a competitive multiple player mode, a group score and bypass token count are maintained, but separate player scores are also maintained. Each player is encouraged either to be the high point player by maximizing his or her score, or instead sacrifice personal scoring for an award if the group score is sufficiently high.

BRIEF DESCRIPTION OF THE DRAWINGS

For a fuller understanding of the nature and desired objects of the present invention, reference is made to the following detailed description taken in conjunction with the accompanying figures wherein like reference character denote corresponding parts throughout the several views and wherein.

DETAILED DESCRIPTION OF THE INVENTION

The present invention relates to an online game of chance and methods of conducting and playing the game. Preferably, the game provides single and multiple player options for an instant-type ticket game, both of which are played over a network. While a preferred embodiment of the game will be described as being played over the Internet, it should be noted that the game can be played equally as well over a LAN, WAN, wireless network, closed circuit network, and the like without violating the scope and spirit of this disclosure. The game can be played on any of the following devices, including but not limited to: a personal computer, a personal digital assistant (PDA), a cellular telephone, a video lottery terminal (VLT), a keno terminal, etc. The game also can be played using a printed instant "scratch" ticket.

Figure 1:
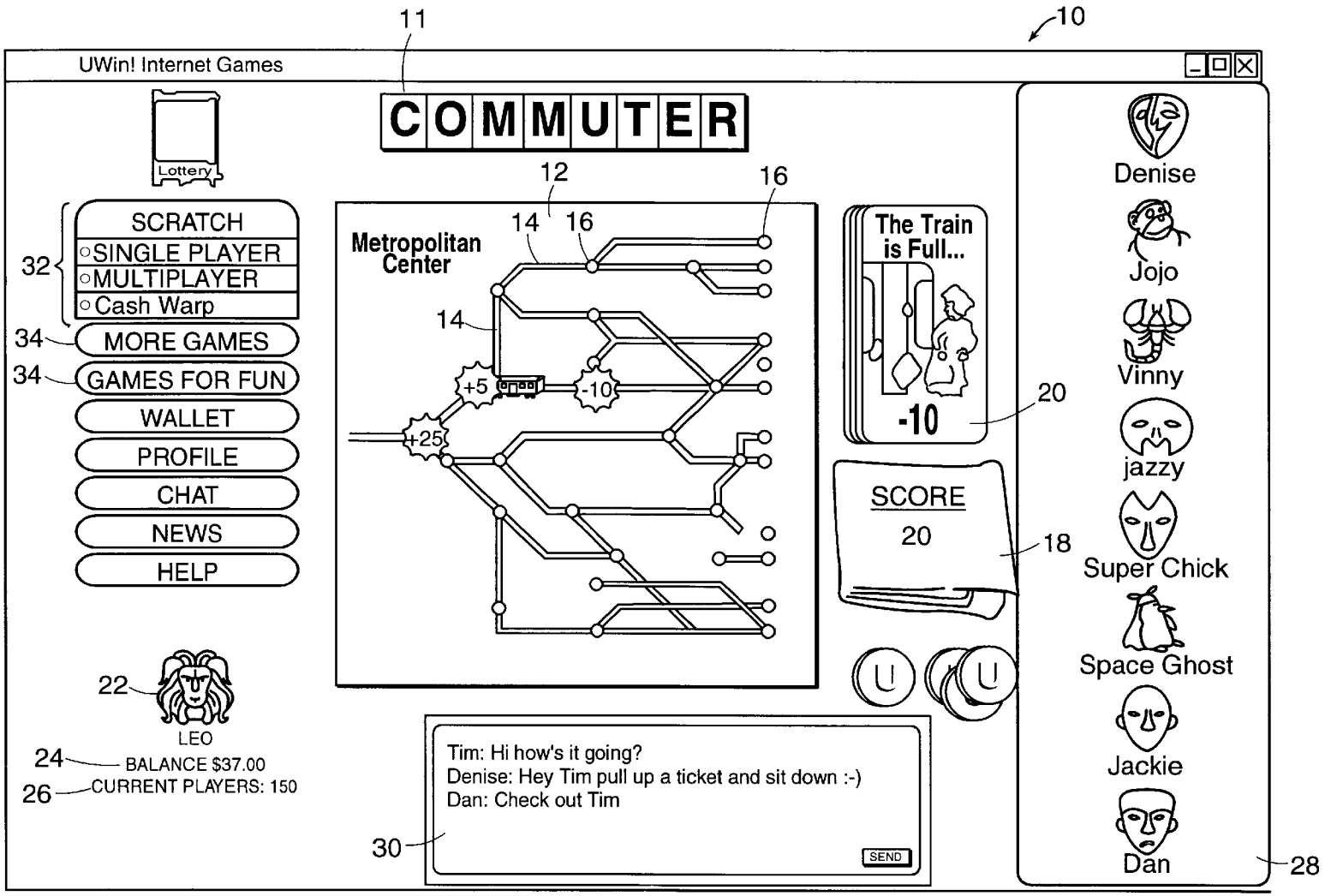
FIG. 1 is a screen printout of an instant ticket game of chance according to a preferred embodiment of the present invention.

FIG. 1 is a printout of a game screen 10 from a web page of an Internet version of the game herein described. The web page is accessed for playing an online game of chance, the game having a banner 11 indicating a title or other information, herein indicating the title of "Commuter." The game screen includes a game image 12, wherein the game image preferably includes a map with a plurality of branches 14, each of the branches corresponding to a path which can be followed during the course of game play. At selected path junctions are a plurality of nodes 16, wherein one node connects two or more branches at each of the selected path junctions. However, certain branches or paths can cross each other without being connected at a node.

In conjunction with the aforementioned layout of a preferred game image 12, game play proceeds as one or more player game piece(s) are advanced over the branches. As a player's game piece reaches a node, the game piece stops and a predetermined action occurs which affects the player's score and/or game status. Preferably, a node provides either a prize increment, prize decrement, or some other game action. In certain embodiments of the game of chance, this "other" game action comprises awarding a "bypass token" or other useful implement to a player. The bypass token can be held by the player to be used at the player's option during the course of the game. Preferably, a player score area 18 displays the score and bypass token count, and optionally any other information relevant to the player and/or group. The player's score and number of accumulated tokens are tabulated and stored in the server and updated during game play.

A node selection by the player produces a graphical and textual indication of a current game action 20 resulting from the particular selection. As seen in FIG. 1, after one particular move the node selection revealed a textual display of "The Train is Full . . . " along with a graphical indication to reinforce this negative result at the node. As shown textually, the score has been reduced by twenty points. If the node had resulted in a positive action, a score increment would be reported along with a positive graphical indication. If a token or other useful implement were uncovered at the node, a graphical and textual indication to this effect would be shown in the game action area 20.

As shown in FIG. 1, the game screen 10 includes an indication of the player's avatar 22 and account balance 24. Optionally displayed below the account balance is an indication 26 of the number of players currently playing the type of game indicated in the banner/title 11. Preferably provided to one side of the game image 12 is a high level menu selection comprising game-specific menu items 32 and additional menu selections 34. The game-specific items 32 can include a game identifier (e.g. "Scratch" as shown in FIG. 1) and, e.g., a listing of modes for playing the identified game. The identified game can be one selected from a plurality of games offered on a particular web site or by a particular provider. The additional menu selections 34 allow the player to obtain additional game-related information, e.g., by finding out more about another game, by participating in an online chat, or by accessing a "help" screen for information on the current game or other games available on the system.

The game screen 10 further includes a game room area 28 containing avatars of one or more players currently playing in a game with the player 22 or optionally including avatars which are part of a preselected group associated with the player 22. If one or more of the avatars are currently participating in the game, preferably adjacent each participating avatar is score and accumulated token information. The players can communicate with each other during the course of the game by typing messages in a chat area 30. Thus, players can provide real-time advice and commentary and thereby interact with other players in the game room.

Figure 3:
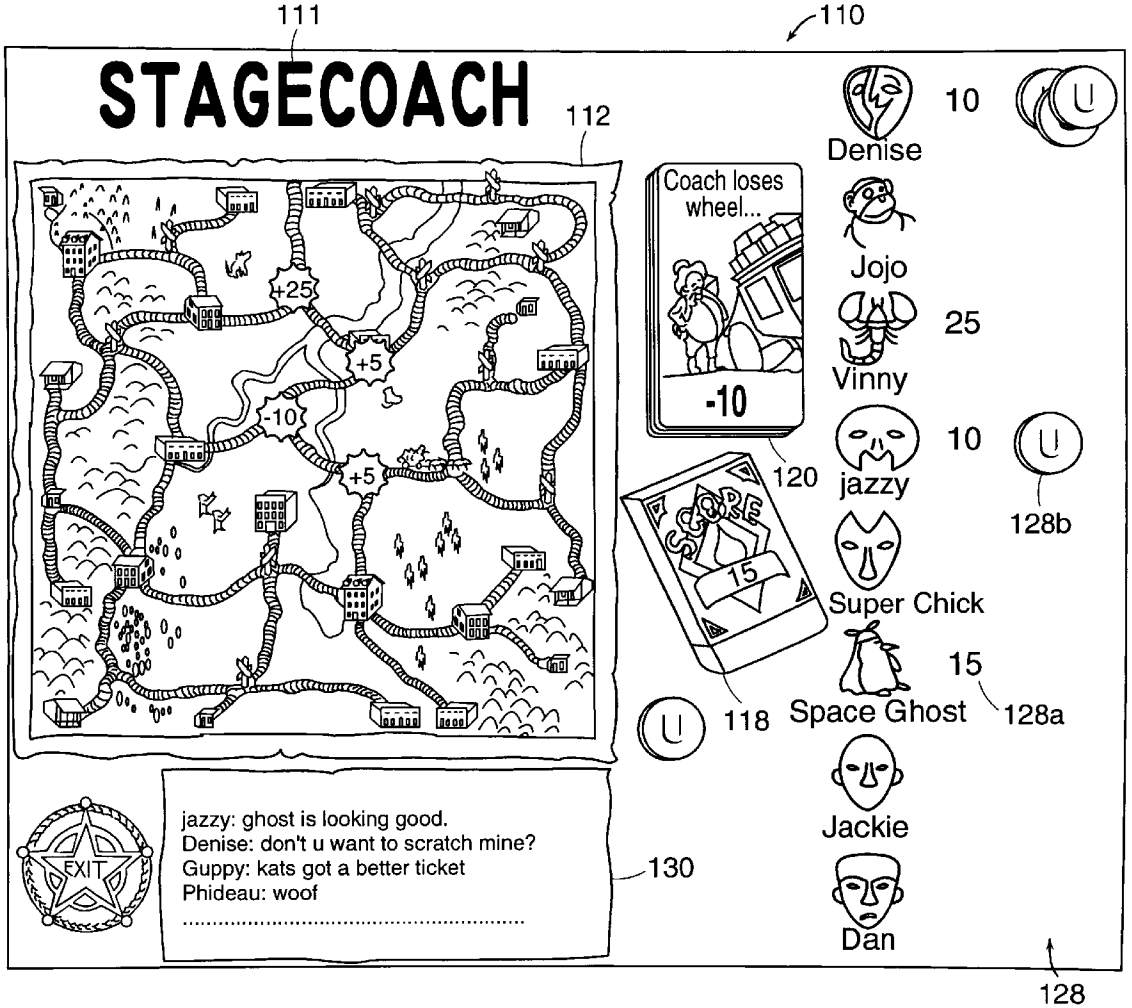
FIG. 3 is a screen printout of an instant ticket game of chance according to another preferred embodiment of the present invention.

Another preferred embodiment of a game of chance according to the present invention is depicted in FIG. 3. Like reference numerals from FIG. 1 are preceded by a "1" in FIG. 3; for example, reference numeral 110 refers to a game screen in the embodiment of FIG. 3 similar to the game screen 10 of FIG. 1. FIG. 3 is a variation of the game of chance herein described, having a title 111 indicated as "Stagecoach" and a Western theme. A game image 112 includes a map having a plurality of branches, each appearing as a "dirt" path on the game image, and a plurality of nodes, wherein at each node a building, sign, or other structure is depicted. The game is played in the same manner as described with reference to FIG. 1. A current game action 120 is indicated along with a graphical and textual depiction of a result of landing on the particular node. A player score area 118 includes the player's avatar and/or score and token information. The other players' avatars are included in a game room area 128, herein depicted with updated scores 128*a* and accumulated tokens 128*b*. As in the embodiment of FIG. 1, players in a multiple player game can communicate with each other in a chat room area 130. FIG. 3 is a variation of a game of chance according to the present invention, and further details of the game are discussed in the description accompanying FIG. 1.

A method for accessing the game and selecting a game mode will now be described. To play the game, players need a computer system that includes a central processing unit, data memory, e.g., random access memory (RAM) and/or read only memory (ROM), one or more input/output (I/O) devices, e.g., a display screen, mouse, or trackball, and Web browser software. The computer system can be in the form of a personal digital assistant, a cellular telephone, or other device capable of accessing a network. The Web browser software permits players to communicate with a game server over the network, e.g., the Internet, in general, or the World Wide Web, specifically. For example, Web browser software enables player servers to transmit data to the game server; receive data, e.g., in hyper-text markup language (HTML), from the game server; and display that data in a human readable format on, e.g., a display screen. Alternatively, the game can be played on a closed circuit machine or dedicated device such as a video lottery terminal.

The game server, which can include a combination of one or more servers, includes data memory, e.g., RAM and/or ROM, and supporting software for hosting a plurality of games, e.g., providing each player with an option of participating in one of the game modes; providing each player with a game screen 10 corresponding to the selected game; combining a plurality of players into a playing group; recording the choices effected by players; and determining whether the player(s) have won a prize and the amount of that prize, and communicating with a plurality of player computer systems.

In an Internet version of the game, once a player has accessed, i.e., downloaded, the game server's Web site, software in the game server transmits data to the player's computer system that requests the player to register, if a first time (unknown) visitor, or to identify himself or herself, if a repeat visitor. To register, a player provides responses to queries for personal information about the player, e.g., name, address, email address, telephone number, credit card number, and the like. Typically, players respond to these queries using a keyboard, mouse, and/or trackball. Once a player has provided the requisite information, he or she is prompted to select a password/passphrase and an access code or personal identification number (PIN), which the game server will use on all subsequent visits to identify the player. Furthermore, prior to the start of play, the game server will provide players with the rules, regulations, and conditions of playing the game, including provisions on how wagers will be made and paid for, e.g., by debiting the player's credit card account. Players have to signify that they accept these conditions of play by clicking on the appropriate button.

Having accessed the game server's Web site and registered to play, players are then asked which of the game modes they would like to select Preferably, players can select from the following game modes: single player mode, cooperative multiple player mode, or competitive multiple player mode. If either of the multiple player modes is selected, the players are prompted as to whether they want to join a playing group, or, in the alternative, whether they want to join a particular group of players who also have logged on to the game server's Web site and registered. If a player indicates that he or she wants to play with a particular group of players, he or she is asked to provide a name of the group, which either creates an address in memory to which subsequent players will be directed or directs players to the playing group at that address.

For example, player A agrees to play a game with her friends B, C, D, E, F, G, H, and I at a particular time, using a group name of FRIENDS. At the appointed time, player A logs on and registers as described above. She selects a cooperative multiple player mode and when prompted whether she wants to play with a particular group, player A clicks on the button for the affirmative and then either types the group name FRIENDS or clicks on FRIENDS when it appears in a window containing a list of group names. To preclude uninvited guests from entering a group, a password, which is known only to the affiliated players, can be used.

An illustrative embodiment of a computer screen display in accordance with the present invention is shown in FIG. 1. Concurrent with providing a player with a screen display 10, the game server debits each player's, e.g., credit card, account the prescribed fee for playing the game. Preferably, to play a game, the game server draws one predetermined outcome ticket from a fixed prize pool. The prize value of the ticket is multiplied by the number of players participating in the game room. Alternatively, tickets can be drawn for the players in the room and their various prize amounts are combined to form one final prize amount, to be divided among the players.

In certain embodiments of the game, a ticket can be tagged with a "bonus" coin, token, or emblem which increases the player's odds of attaining a high score on the ticket. For example, after the player has entered the information required for a game play, the player can be notified that the game is a bonus game and his or her chances of scoring well by landing on branches with high prize values has been increased. The game as described with reference to FIGS. 1–3 does not include the "bonus" feature.

In single play mode, the player selects from among different branches to follow a selected path between the starting and finishing points. Preferably at each node, the player is awarded a prize increment, is penalized a prize decrement, or gains a bypass token. If the player lands on a prize decrement node, the player can decide whether to use a bypass token to thereby avoid a penalty. At the end of the game, the prize value remaining after all branch node increments and decrements becomes the player's final prize.

In group play, whether cooperative or competitive, the players take turns deciding which branch to follow as the game progresses from the starting to finishing points. Game play proceeds in a manner similar to single play mode, with the player receiving a prize increment, a prize decrement, or a bypass token at selected nodes. If the player lands on a prize decrement node, the player can decide whether to use a bypass token (if the group has one) to avoid the penalty. The chat function enables team members to discuss strategy before a player makes his/her decision.

In group play, the order of turns is preferably based on order of entry into the game room. Optionally, any other criteria can be used to select order of turns, including a randomly selected order. The avatar of the first player illuminates, indicating to all players in the game that the first player must make a move. The first player can select a starting path branch within an allotted time interval to initiate the game. Preferably, the game incrementally marks progress toward the next branch node using a path marker, which serves as a timer for the next player's turn. The next player's avatar illuminates, and the player must select the next branch before the path marker reaches the next node. Alternatively, a built-in counter or other timer can be used to cause the game to progress. Each turn results in a prize increment, prize decrement, or a bypass token for each branch (awarded at the corresponding node). The team's accumulated prize and number of bypass tokens are tallied adjacent the game image 12. Play continues until a final destination (i.e. end of a branch) is reached.

Figure 2A:
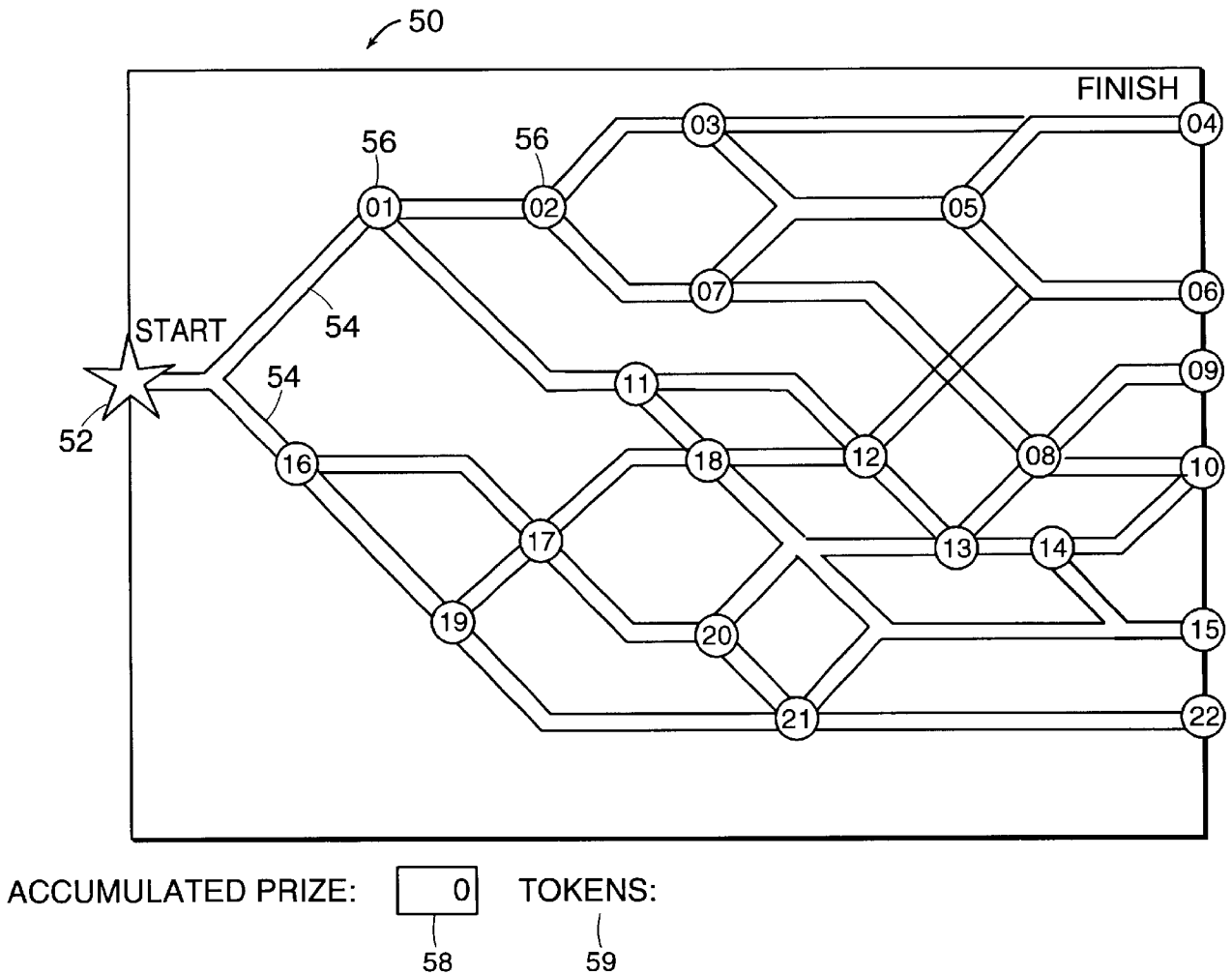
FIGS. 2A–2G are schematic depictions of a sample game sequence in a single player mode according to the present invention.

A sample game play sequence for a single player mode will now be discussed with reference to FIGS. 2A to 2G. After the player provides account and/or credit card information to confirm a game play purchase, the game server draws one predetermined outcome ticket from a fixed prize pool. FIG. 2A is a schematic depiction of a generic game image 50 represented on the ticket. In an actual game, the screen preferably contains one or more additional elements as shown in FIG. 1, and the game image 50 provides various graphical clues related to a particular game theme. In general, the game image 50 provides the player with a map having a plurality of branches 54 connected by a plurality of nodes 56. Nodes generally exist at the junction of two or more branches. However, certain junctions do not have nodes, indicating that the branches simply traverse one another. As seen in FIG. 2A, the nodes 56 can be numbered or can contain other information, such as the name of a geographical location, in accordance with the game theme. The player's score 58 and accumulated bypass tokens 59 are displayed adjacent the game image 50.

Figure 2B:
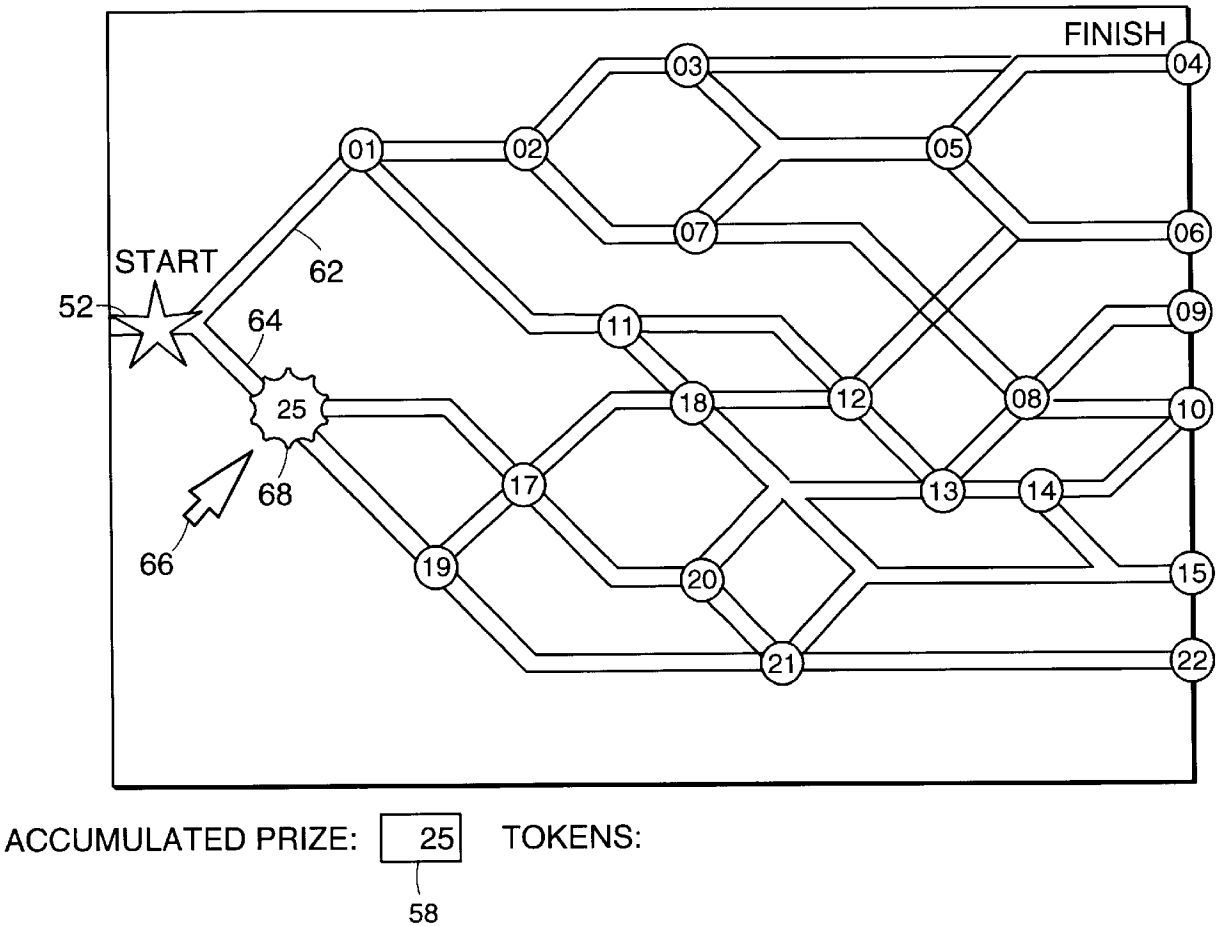

According to a sample game, the player's current position is marked using a marker (herein depicted as a star) at a starting point 52 (see FIG. 2A). From there, the player must choose between a first branch 62 and a second branch 64. In the illustrated game, as seen in FIG. 2B, the player has selected the second branch 64 by positioning an arrow 66 over the branch 64 or node 68 and clicking with a mouse or other input device. The node 68 reveals a result of the selection, in this case an award of 25 points. The player's score is incremented by 25 points, and the player can select the next branch/node.

Figure 2C:
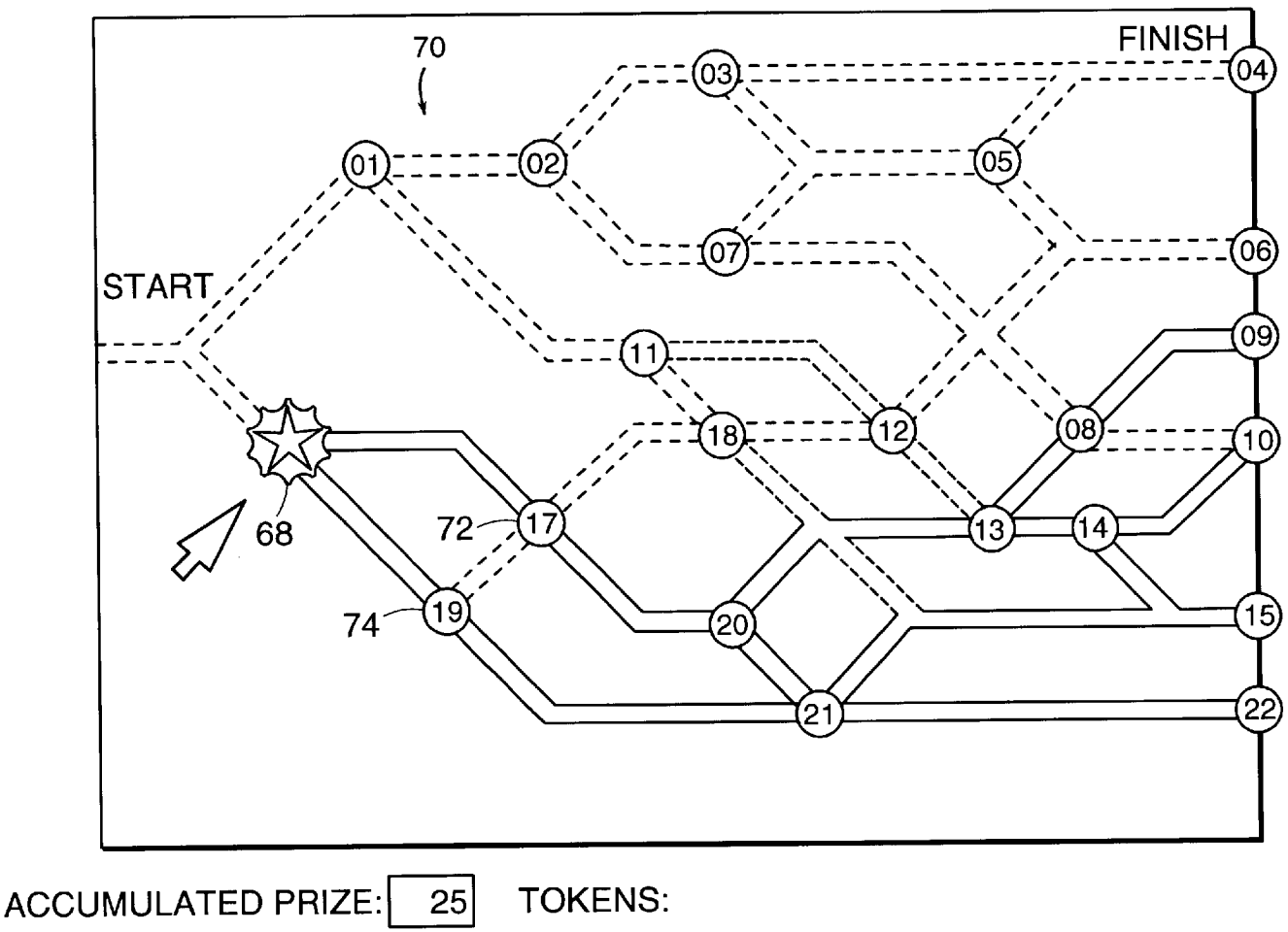
Figure 2D:
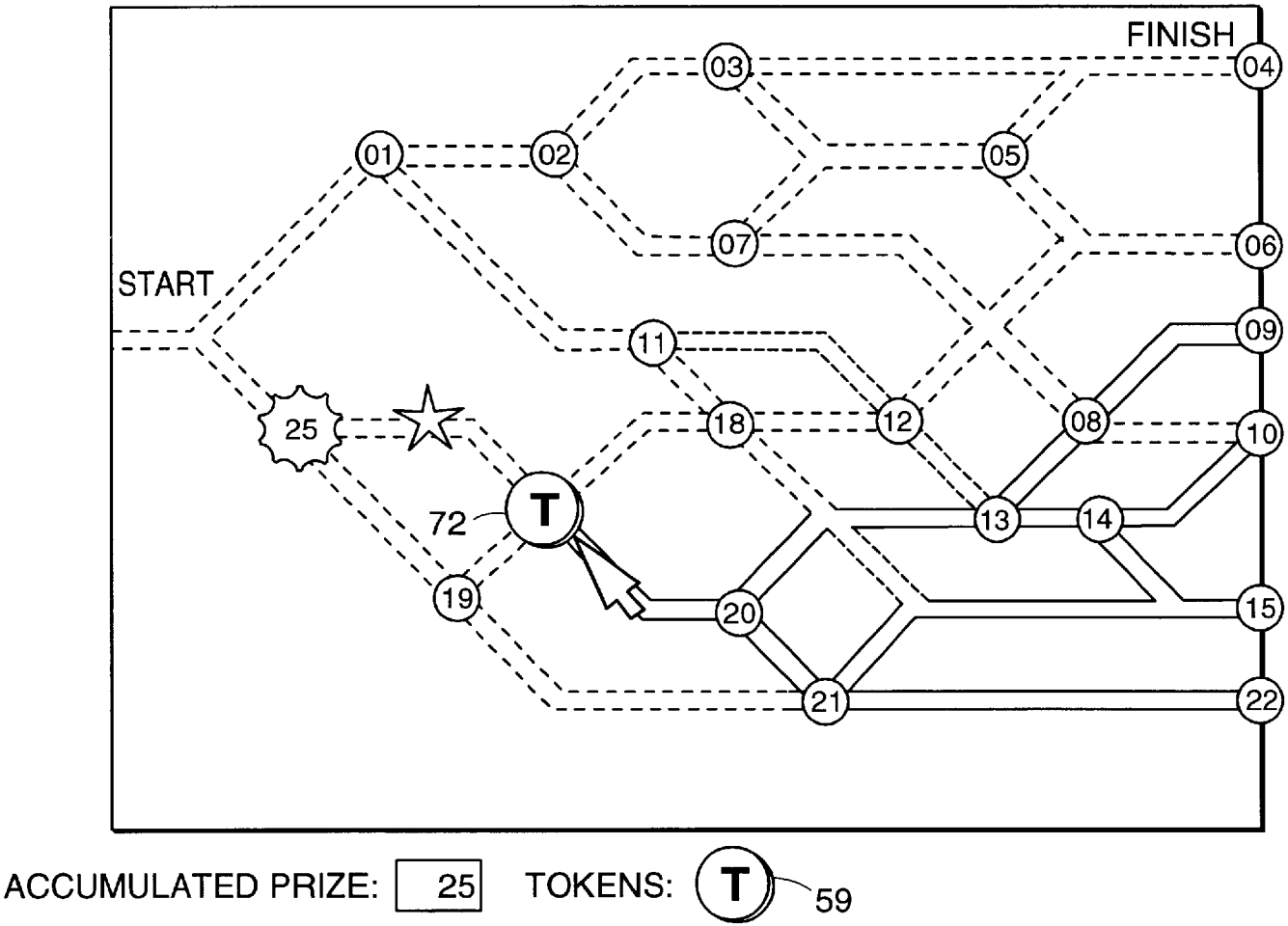

As seen in FIG. 2C, the player's marker has advanced to the selected node, and now a further selection must be made. Preferably to keep the player moving in the proper direction, non-selected paths 70 are made unavailable and are depicted in a different shade or color than available paths. The player now must select between the branches represented by node 72 and node 74. In FIG. 2D, the player has selected the node 72, and the marker advances toward that node. The node 72 has revealed a bypass token, which is added to the player's token area 59.

Figure 2E:
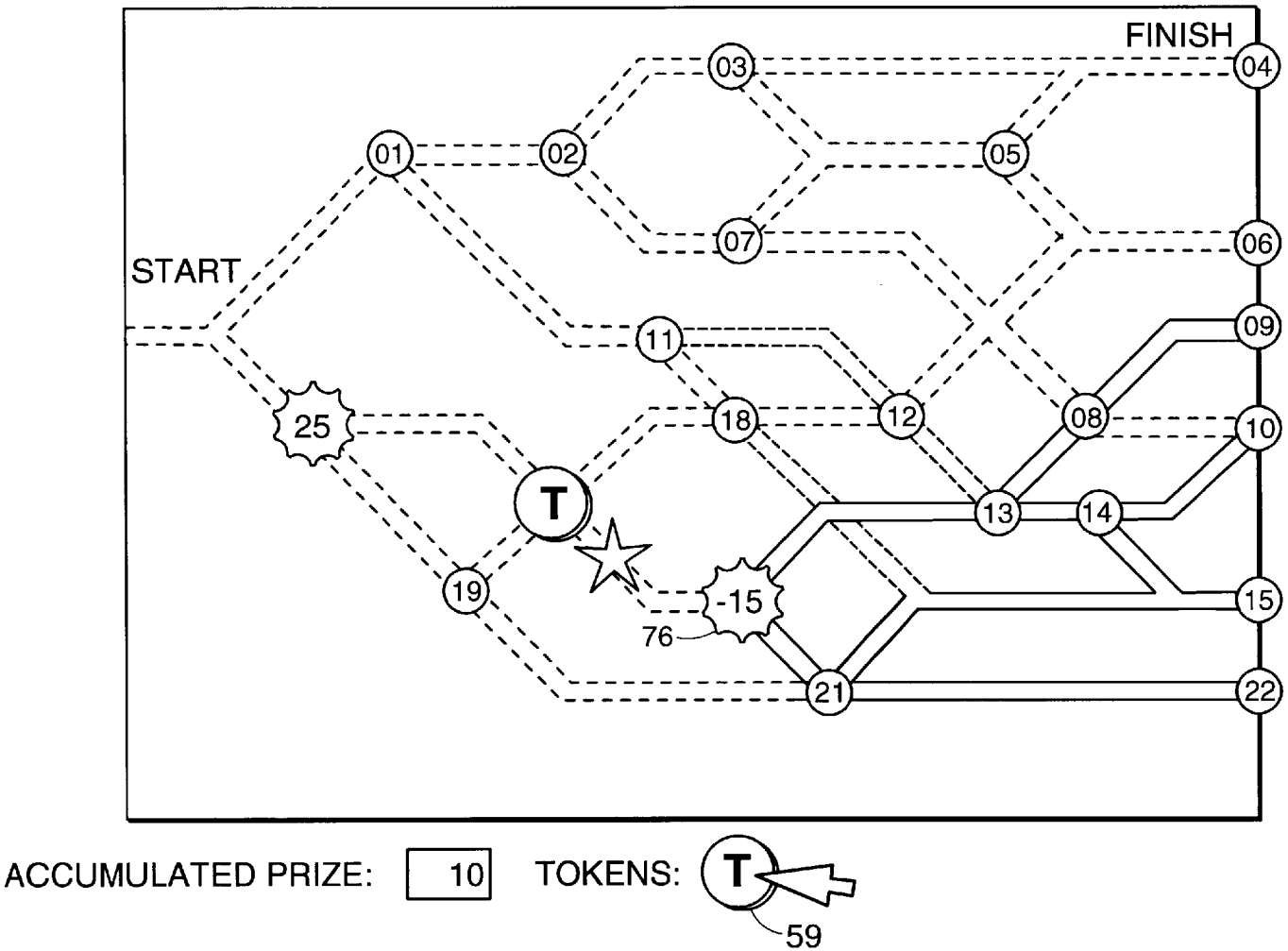

After the node 72 has been selected, only one branch/node is available for the next move. The player can click on the node 76 or the server will automatically select it. As seen in FIG. 2E, the node 76 has revealed a prize decrement, in this case a "−15" indicating that 15 points are to be subtracted from the player's score. However, since the player has accumulated a bypass token, as indicated in the token area 59, the player can click on the bypass token to use the token and thereby avoid the penalty. Alternatively, the player can hold the bypass token in order to protect against a larger decrement which could be encountered later in the game. As indicated in FIG. 2E, the player has chosen to use the bypass token, thereby avoiding the penalty.

Figure 2F:
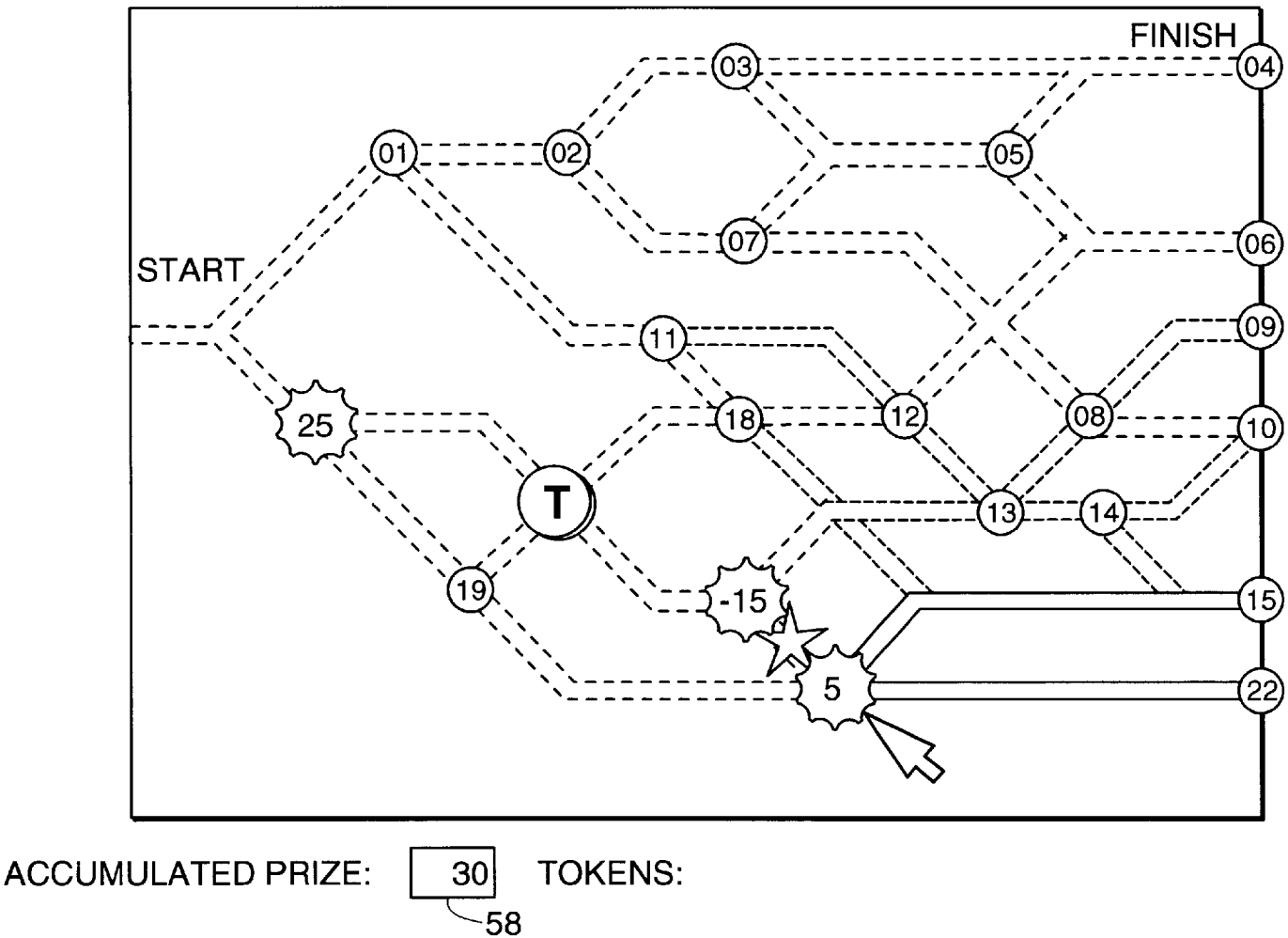
Figure 2G:
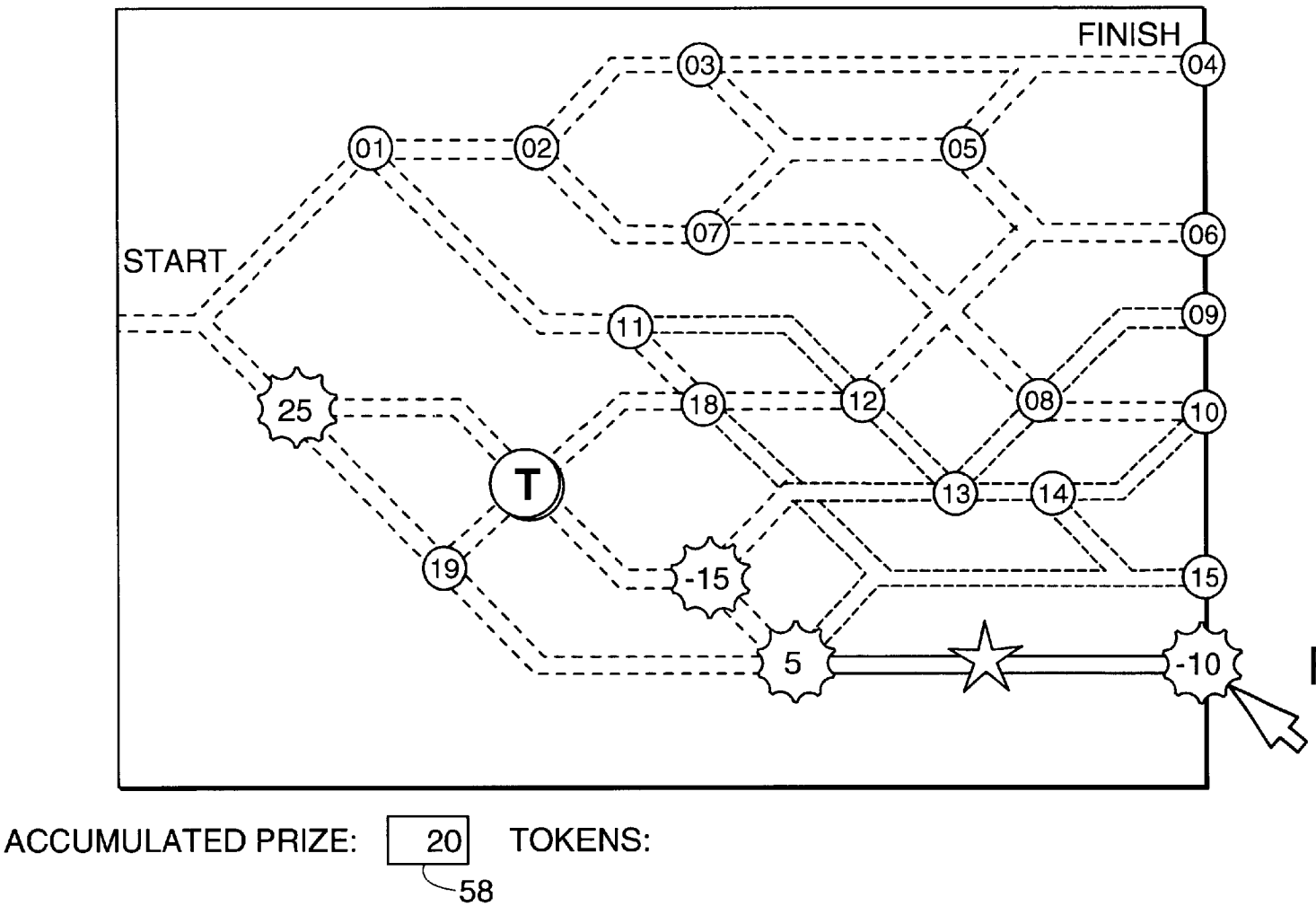

As seen in FIG. 2F, the player's next choice reveals a prize increment of 5 points, which is added to the player's score. The following choice, as indicated in FIG. 2G, leads to a finishing point and the selected node reveals a decrement of 10 points. The player's final score, as indicated in the score area 58, is 20 points, which is credited to the player's account. For example, the 20 points can represent 20 dollars, and the player's account balance would be credited by 20 dollars. Preferably, the player's account is never debited, except for the initial cost of the ticket. For example, if the final score were a negative number, the player's account would not be debited any additional amount.

The above sequence represents a sample game sequence in accordance with paths (i.e. branches or nodes) selected by a particular player. The paths followed during a game and any actions taken (e.g. the use of bypass tokens) will necessarily depend on an individual player's choices.

The second and third modes of playing the game are group play modes, namely a cooperative multiple player mode and a competitive multiple player mode. These modes use a game image and a game screen similar to that used for the single player mode. The game screen of FIG. 1 illustrates a typical arrangement appropriate for group play, including the game room area 28 which contains other players' avatars and their respective scores and token counts (not shown). The chat area 30 enables communications between the players to facilitate strategy discussions between group members, and to allow coordination, if desired, at game decision points.

In the second mode, i.e. cooperative multiple player mode, the cost to each player is the same as in the single player game (e.g. $10 for a ticket, or in this case $10 to participate on a ticket). The prize structure for an n-player game is a simple n multiplier of the single player prize structure, e.g., a $10 single player prize tier becomes a $40 prize tier in a 4-player game. A turn control mechanism and/or timer monitors the turns and allows an equal time interval for each player's turn. Preferably, if a player does not make a selection in the allotted time, the server makes a selection for the player, in order to keep the game moving in the event of an inattentive or disconnected player.

When team readiness meets pre-defined criteria, such as when all the players in a game room have confirmed game play purchases, the game server randomly selects and logs a predetermined outcome ticket for the game. A turn arbitrator (not shown) designates the first player's turn and a sequence of turns for the other players and notifies all players accordingly. Game play commences with the first player and then each other player taking a turn in sequence. If a player does not complete a move in an allotted time interval, the game server randomly selects one of the available options. Preferably, game play is similar to that discussed above with reference to the single player mode. However, group play provides multiple player involvement and the ability to communicate between the players. Further, each turn and the resulting game actions affect the entire group. For example, any bypass tokens accumulated by the group can be used by any player(s) at their option. Thus, one player can use a bypass token earned by another player, in order to maximize the group's final score. When a turn results in a finishing point being reached, the game is then completed, and the accumulated prize preferably is divided equally among all of the players in the group.

According to the third mode, i.e. competitive multiple player mode, game play proceeds in a manner similar to the second mode, with each player taking a turn in sequence. The prize structure is based on the number of participating players multiplied by the individual game play cost. Running totals of the group's overall score and accumulated bypass tokens are maintained. However, scores are also maintained separately for each player. Preferably, prizes can be awarded in a distribution favoring individual play but also encouraging high overall group scores. Prize distribution formulas are readily adjustable. One particular scheme is depicted below:

| | Share of End Prize Balance | | |
|---|---|---|---|
| End Prize Balance | High Point Player(s) | Low Point Player(s) | Remaining Players Consolation Prize |
| Up to $20 | 100% | 0% | 0% |
| $20 to $200 | 80% | 20% | 0% |
| More than $200 | 70% | 20% | 10% |

In the above scheme, players are encouraged to seek a high score for the group, as all players share in the highest prize totals. In particular, player(s) who have little chance of winning are encouraged to sacrifice their score in hopes of becoming the low point player and winning a 20% prize, but only if the overall group prize balance is sufficiently high. Such a scheme encourages wise use of bypass tokens for the group's benefit. However, in competitive multiple player mode, high point player(s) are permitted to keep a majority of their share of the winnings.

Although the invention has been described in detail including the preferred embodiments thereof, such description is for illustrative purposes only, and it is to be understood that changes and variations including improvements may be made by those skilled in the art without departing from the spirit or scope of the following claims.

What is claimed is:

1. An online game of chance that is played by at least one player, the game comprising:

a game screen including a map having a plurality of nodes connected by a plurality of branches arranged between a starting point and a plurality of finishing points, wherein game play progresses to a branch or node when selected by the player, the branch or node being selected from a plurality of branches or nodes available on the map, wherein the selection of the branch or node results in a prize increment, a prize decrement, or an award of a token; and a computer means for tabulating prize and token information, the information being updated upon the selection of each branch or node, wherein after one of the finishing points is reached, a final prize is awarded to the player.

2. The game as recited in claim 1, wherein the game is played by a plurality of players, each of the players taking a turn in sequence.

3. The game as recited in claim 2, wherein the game screen further includes a display of a score of each of the players.

4. The game as recited in claim 2, wherein the game screen further includes a display of an avatar for each of the players.

5. The game as recited in claim 2, wherein the final prize is shared by the players.

6. The game as recited in claim 1, wherein a prize decrement can be negated by a token selected by the player.

7. The game as recited in claim 1, wherein the game comprises an instant lottery-type game.

8. The game as recited in claim 1, wherein the game comprises an interactive, online game.

9. An online game of chance that is played by a plurality of players, comprising:

a game screen viewable by each player, the game screen including a map having a plurality of nodes connected by a plurality of branches arranged between a starting point and a plurality of finishing points, wherein each of the players takes a turn in sequence selecting a branch or node from a plurality of branches or nodes available on the map, wherein the selection of the branch or node results in a prize increment, a prize decrement, or an award of a token; and a computer means for tabulating prize and token information, the information being updated upon the selection of each branch or node, wherein after one of the finishing points is reached, a final prize is awarded to the plurality of players.

10. The game as recited in claim 9, wherein the game screen further includes a display of a score of each of the players.

11. The game as recited in claim 9, wherein the game screen further includes a display of an avatar for each of the players.

12. The game as recited in claim 9, wherein the final prize is shared by the players.

13. The game as recited in claim 9, wherein a prize decrement can be negated by a token selected by the player.

14. A method of conducting an online game of chance, comprising:

registering one or more players for a game;

issuing each of the players a virtual ticket including a game screen with a map having a plurality of nodes connected by a plurality of branches arranged between a starting point and a plurality of finishing points;

allowing each player to take a turn in sequence by selecting a branch or node from the plurality of branches or nodes available on the map, wherein the selection of the branch or node results in a prize increment, a prize decrement, or an award of a token;

updating and displaying prize and token information for each player after each turn; and awarding a final prize after one of the finishing points is reached.

15. The method as recited in claim 14, wherein the game screen further includes a display of an avatar for each of the players.

16. The game as recited in claim 14, wherein the final prize is shared by the players.

17. The game as recited in claim 14, wherein a prize decrement can be negated by a token selected during a turn.

18. The game as recited in claim 14, wherein the game comprises an instant lottery-type game.

19. A system for facilitating the play of a game, comprising:

a game screen including a map having a plurality of nodes connected by a plurality of branches arranged between a starting point and plurality of finishing points;

an input device configured to receive a player's selection of one of the plurality of nodes or one of the plurality of branches on the map; and a game server configured to receive the player's selection from the input device and to update prize and token information in response to the receipt of the player's selection of each branch or node.

20. The system of claim 19, wherein a prize increment is associated with a first one of the plurality of branches or nodes, a prize decrement is associated with a second one of the plurality of branches or nodes, a token is associated with a third one of the plurality of branches or nodes.

21. The system of claim 20, wherein the game screen is further configured to display the prize increment when the first one of the plurality of branches or nodes is selected by the player, and to display the prize decrement when the second one of the plurality of branches or nodes is selected by the player; and to display the token, when the third one of the plurality of branches or nodes is selected by the player.

22. The system of claim 21, wherein the input device is further configured to receive from the player a selection of the token in response to the display of the prize decrement.

23. The system of claim 22, wherein the server is further configured to negate a prize decrement in response to the receipt of the selection of the token.

24. A method of conducting a game, comprising:

issuing a player a virtual ticket including a plurality of nodes connected by a plurality of branches arranged between a starting point and a plurality of finishing points;

receiving a selection of a branch or node from the player;

updating prize and token information responsive to the selection of a branch or node by the player; and awarding a final prize after one of the finishing points is reached.

25. The method of claim 24, further comprising:

receiving from the player a selection of a first branch or node associated with a token;

awarding the token to the player in response to the player's selection of the branch or node associated with the token;

receiving from the player a selection of a second branch or node associated with a prize decrement; and negating the prize decrement with the token.

* * * * *